US007553042B2

(12) United States Patent
Hagen

(10) Patent No.: US 7,553,042 B2
(45) Date of Patent: Jun. 30, 2009

(54) IN-GRADE LIGHT FIXTURE

(76) Inventor: Douglas W. Hagen, 31208 Big River Way, Coarsegold, CA (US) 93614

( * ) Notice: Subject to any disclaimer, the term of this patent is extended or adjusted under 35 U.S.C. 154(b) by 207 days.

(21) Appl. No.: 11/266,843

(22) Filed: Nov. 4, 2005

(65) Prior Publication Data

US 2006/0114668 A1 Jun. 1, 2006

Related U.S. Application Data

(60) Provisional application No. 60/625,472, filed on Nov. 4, 2004.

(51) Int. Cl.
*E01F 9/00* (2006.01)

(52) U.S. Cl. ..... 362/153.1; 362/153; 362/364; 362/372; 362/269; 362/294

(58) Field of Classification Search ..... 362/153.1, 362/364, 372, 153, 269, 294
See application file for complete search history.

(56) References Cited

U.S. PATENT DOCUMENTS

| | | | | |
|---|---|---|---|---|
| 1,240,452 | A | 9/1917 | Hotchkin | 103/86 |
| 2,806,080 | A | 9/1957 | Corey | 346/636 |
| 3,635,808 | A | 1/1972 | Elevitch | 204/180 G |
| 3,770,878 | A | 11/1973 | Dozier | 174/153 R |
| 3,949,213 | A | 4/1976 | Paitchell | 240/26 |
| 4,131,331 | A | 12/1978 | Kendall, Jr. | 339/126 RS |
| 4,539,629 | A | 9/1985 | Poppenheimer | 362/267 |
| 4,574,337 | A | 3/1986 | Poppenheimer | 362/267 |
| 4,617,616 | A | 10/1986 | Juell et al. | 362/267 |
| 4,674,187 | A | 6/1987 | Poppenheimer | 30/360 |
| 4,768,139 | A | 8/1988 | Poppenheimer | 362/302 |
| 4,931,915 | A | 6/1990 | Quiogue | 362/267 |
| 4,999,757 | A | 3/1991 | Poppenheimer | 362/287 |
| 5,041,950 | A | 8/1991 | Tyson | 362/96 |

(Continued)

FOREIGN PATENT DOCUMENTS

| | | |
|---|---|---|
| DE | 3635808 | 5/1988 |

OTHER PUBLICATIONS

Hydrel Data Sheet, 9000 Series Incandescent 75 Watt Max. In-grade Luminaire, IP67, Apr. 2000.

(Continued)

*Primary Examiner*—Sandra L O'Shea
*Assistant Examiner*—Jessica L McMillan
(74) *Attorney, Agent, or Firm*—Koppel, Patrick, Heybl & Dawson

(57) ABSTRACT

An in-grade light fixture comprises a light fixture housing arranged to be buried substantially below grade level. The light fixture housing has a light opening substantially at grade level and an optical chamber having a light source arranged within the optical chamber and the optical chamber arranged within the housing with light from the light source passing through the light opening. The fixture further comprises a plurality of housing openings and one or more enclosures, each of which is removably mounted to a respective one of the housing openings. The enclosures accept external power and generate power to energize the light source causing it to emit light. The optical chamber can also comprise an anti-condensation valve and an air passageway between the optical chamber and one of the enclosures form a vacuum in the optical chamber and vacuum during operation.

23 Claims, 3 Drawing Sheets

U.S. PATENT DOCUMENTS

| | | | | |
|---|---|---|---|---|
| 5,050,052 | A | 9/1991 | Wade | 362/101 |
| 5,207,499 | A | 5/1993 | Vajda et al. | 362/96 |
| 5,276,583 | A | 1/1994 | Tyson | 361/679 |
| 5,349,505 | A | 9/1994 | Poppenheimer | 362/101 |
| 5,408,397 | A | 4/1995 | Tyson | 362/267 |
| 5,481,443 | A | 1/1996 | Wagner et al. | 362/153.1 |
| 5,483,428 | A | 1/1996 | Poppenheimer | 362/101 |
| 5,486,988 | A | 1/1996 | Tyson | 362/267 |
| 5,556,188 | A | 9/1996 | Poppenheimer | 362/101 |
| 5,727,873 | A | 3/1998 | Tyson | 362/294 |
| 5,743,622 | A | 4/1998 | Ibbitson et al. | 362/153.1 |
| 5,842,771 | A | 12/1998 | Thrasher et al. | 362/101 |
| 5,887,966 | A | 3/1999 | Eissner et al. | 362/153.1 |
| 5,908,236 | A * | 6/1999 | Lueken et al. | 362/364 |
| D461,267 | S | 8/2002 | Arumugasaamy | D26/85 |
| 6,481,867 | B2 | 11/2002 | Ewing | 362/226 |
| D467,676 | S | 12/2002 | Packer et al. | D26/72 |
| D467,677 | S | 12/2002 | Reis et al. | D26/88 |
| D468,046 | S | 12/2002 | Bernard et al. | D26/85 |
| D468,049 | S | 12/2002 | Reis et al. | D26/89 |
| 6,492,590 | B1 * | 12/2002 | Cheng | 174/50 |
| 6,499,866 | B1 | 12/2002 | Logan et al. | 362/362 |
| 6,530,681 | B2 | 3/2003 | Sieczkowski | 362/404 |
| D472,665 | S | 4/2003 | Herst et al. | D26/113 |
| D472,666 | S | 4/2003 | Herst et al. | D26/113 |
| D472,667 | S | 4/2003 | Herst et al. | D26/118 |
| D472,668 | S | 4/2003 | Herst et al. | D26/118 |
| D473,007 | S | 4/2003 | Herst et al. | D26/113 |
| D473,335 | S | 4/2003 | Brohard et al. | D26/113 |
| D473,672 | S | 4/2003 | Lay et al. | D26/80 |
| 6,540,374 | B2 * | 4/2003 | Kira et al. | 362/153.1 |
| 6,577,136 | B1 | 6/2003 | Marques | 324/426 |
| D476,771 | S | 7/2003 | Herst et al. | D26/155 |
| D477,105 | S | 7/2003 | Herst et al. | D26/76 |
| 7,156,226 | B1 * | 1/2007 | Van Sickle | 206/216 |

OTHER PUBLICATIONS

Hydrel Data Sheet, 9100 Series HID 175 Watt Max. In-grade Luminaire, IP67, Nov. 2000.

Hydrel Data Sheet, 9100 Series Incandescent 250 Watt Max. In-grade Luminaire, IP67, Apr. 2000.

Hydrel Data Sheet, 9300 Series 9½" Dia. Well Lights, IP67, May 2003.

Hydrel Data Sheet, 9350 Series 11½" Well Lights, IP67, May 2003.

Hydrel Data Sheet, M9400 Series Fluorescent 32 Watt Max. Modular In-grade Luminaire Double Lens, IP67, Nov. 2000.

Hydrel Data Sheet, M9700 Series Fluorescent 42 Watt Max. Modular In-grade Luminaire Double Lens, IP68, Nov. 2000.

Hydrel Data Sheet, M9800 Series HID 400 Watt Max. Modular In-grade Luminaire Double Lens, IP67, Nov. 2000.

Hydrel Data Sheet, WD9000 Series Low Voltage 75 Watt Max. "Wet/Dry" Fixture, IP67, Nov. 2000.

Hydrel Data Sheet, WD9100 Series Incandescent 250 Watt Max. "Wet/Dry" Up-lights, Nov. 2000.

Kim Lighting Inc., Concept 5000 Catalog, © 1982, this version © 1993, Version Sep. 1993.

Hydrel Catalog, p. 15, Models 6322-6324 300 Watt Incandescent—240 Watt 12V Incandescent.

Hydrel, Update Letter Architectural & Landscape Catalog, Sep. 1, 1986.

Hydrel Catalog, p. 14, Models 6302 & 6312-6316 150 Watt Incandescent—100/175Watt Mercury Vapor.

Prescolite DW10/89, O-108, Low Voltage Incandescent Ground Mount Precision Uplights, Flush Guard with Convex Tempered Lens, Copyright 1989.

Hydrel Architectural & Landscape Catalog, p. 1-30.

Prescolite Catalog, Selection Index and pp. 4-10.

Prescolite DW10/89, O-115, HID Ground Mount Precision Uplights, Lexan Dome with Convex Tempered Lens, Copyright 1989.

Prescolite DW10/89, O-105, Incandescent Ground Mount Precision Uplights, Lexan Dome with Convex Tempered Lens, Copyright 1989.

Hydrel 6000 Series Architectural Lighting Catalog.

US2001/0017775 A1, Aug. 30, 2001, Reinert, Sr.

US 2002/0044443 A1, Apr. 18, 2002, Kira et al.

Think PEI-Genesis for Military and Industrial Connectors. 2001 *PEI-Genesis*. Apr. 28, 2002 http://www.pei-genesis.com/.

"King Waterproof." 2001. Online Image. *King Safety Products*. Apr. 28, 2002. HTTP://WWW.KINGSAFETY.COM:8080/CLIENT/KINGSAFETY/PRODUCTION/DATA/MODEL/VIEW/WATERPROOF_SPEC_INFO.HTML.

Precision$^2$ In-Grade Lighting: Taking Architectural Lighting to the Next Power. *B-K Lighting*. "HP$^2$ CO$^2$ MR 16 Integral Transformer." p. 5.

Lumiere Coronado 750 Series. "Coronado: Ultra-Compact HID In-Ground Luminaires." *Cooper Lighting*.

"Sure-Seal Connections: Technical Specifications". *Sure-Seal*. Catalog pp. 1-3.

* cited by examiner

FIG. 1
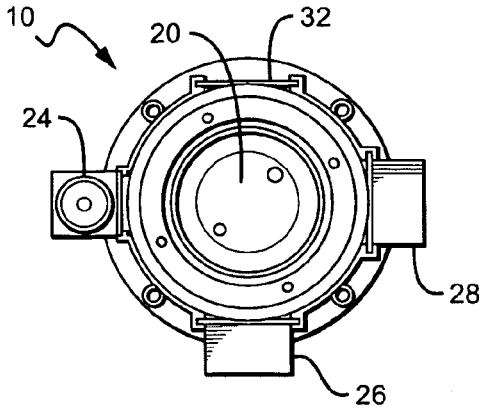
FIG. 2
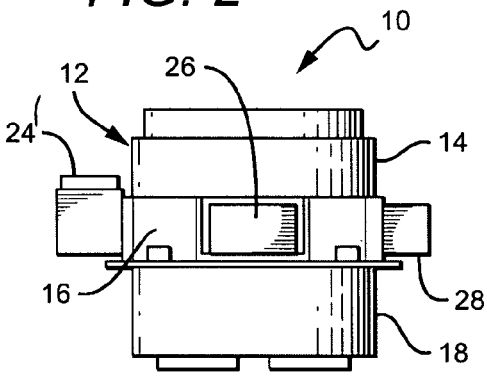
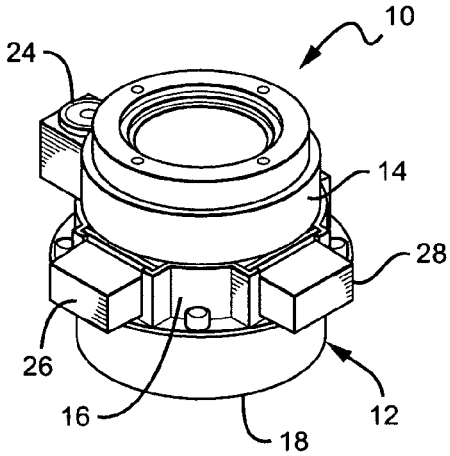
FIG. 3
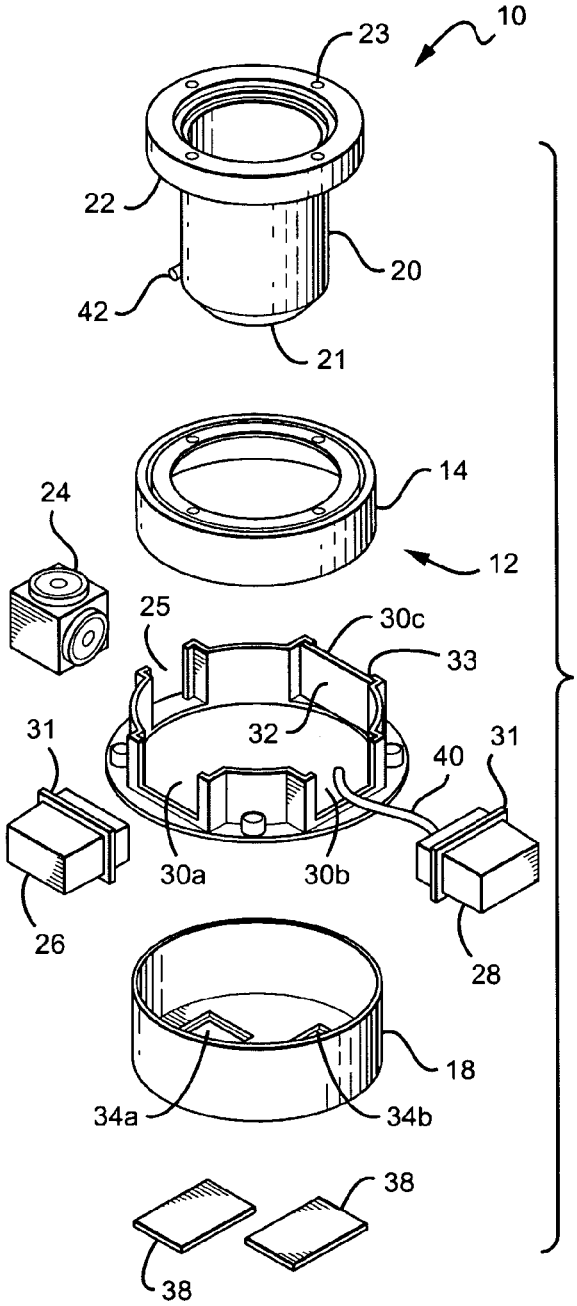
FIG. 4

IN-GRADE LIGHT FIXTURE

This application claims the benefit of provisional application Ser. No. 60/625,472 to Hagen, which was filed on Nov. 4, 2004.

BACKGROUND OF THE INVENTION

1. Field of the Invention

This invention relates to lighting fixtures and more particularly to in-grade lighting fixtures.

2. Description of the Related Art

Conventional in-ground or in-grade lighting fixtures are typically buried all or partially below ground level and include a light emitter that illuminates up from below ground level. They can be buried in the earth or covered by hardscape such as concrete, asphalt, wood, pavers, tile, etc. The fixtures are typically used to illuminate walls, columns, flags, trees, signs or a pathway.

One type of in-grade lighting fixture generally comprises a housing and lens made of glass or other rigid and transparent material that is attached to an opening in the top of a housing. The housing contains various components including the light emitter that is arranged to emit light through the lens and electrical components that are used to power and operate the light emitter. When the light fixture is installed in-grade, the housing is typically below ground level and the lens is left uncovered so light can shine up through it. The electrical components can include a power supply, power converters, transformers, and mounting hardware for the light emitter. To hold all of these components, the housing can extend relatively deep into the ground (i.e. 14 to 16 inches).

During installation of these types of light fixtures, a hole is typically dug for the housing, the housing is placed in the hole and the hole is back filled around the housing. Any hardscape is then installed around the lens, leaving the lens uncovered.

In-grade light fixtures can have an optical chamber that contains the light emitter (lamp), with the optical chamber arranged in the housing so that light from the lamp emits through an upper housing opening. One disadvantage of conventional optical chambers is that condensation can develop inside the chamber through the heating and cooling of the lamp. These types of fixtures also have ballasts that contain electronic components such as transformers and capacitors. These ballasts can also develop condensation during heating and cooling that can cause failure or reduced life of the components.

The most common problems resulting from water inside the housing include corrosion, electrical shorts, shortened life of the ballast (power converter) or transformer and shortened lamp life. In addition, water entry into the electrically sensitive areas can create risk of electrocution for those working on the housing.

In other conventional light fixtures one or more enclosures can be included inside the housing to hold electrical components, which can increase the overall size of the light fixture. Conventional light fixtures also do not provide flexibility in the placement of enclosures to allow the light fixture to be configured to meet space constraints during installation.

SUMMARY OF THE INVENTION

The present invention seeks to provide an improved in-grade light fixture. One embodiment of an in-grade light fixture according to the present invention comprises a light fixture housing arranged to be buried substantially below grade level. The light fixture housing has a light opening substantially at grade level and an optical chamber having a light source arranged within the chamber and the chamber arranged within the housing with light from the light source passing through the light opening. The fixture further comprises a plurality of housing openings and one or more enclosures, each of which is removably mounted to a respective one of the housing openings. The enclosures accept external power and generate power to energize the light source causing it to emit light.

Another embodiment of an in-grade light fixture according to the present invention comprises a light fixture housing arranged to be buried substantially below grade level with the light fixture housing having a light opening substantially at grade level. A junction box is mounted to the housing and the housing comprises a plurality of housing openings. The fixture further comprises one or more enclosures, each of the enclosures capable of being removably mounted in a respective one of each of the openings. The enclosures are interconnected to accept an external power supply and generate an electrical signal to energize a light source.

Another embodiment of an in-grade light fixture according to he present invention comprises a light fixture housing arranged to be buried substantially below grade level. The light fixture housing having a light opening substantially at grade level, with a groove around the opening having an L-shaped cross-section. A light source is arranged within the light fixture housing and generates light that passes through the light opening. A faceplate mechanism is arranged over the light opening and is held in place by mounting screws with the faceplate mechanism at least partially within the groove.

Still another embodiment of an in-grade light fixture according to the present invention comprises a light fixture housing arranged to be buried substantially below grade level with the light fixture housing having a light opening substantially at grade level. One or more enclosures are mounted to the housing and an optical chamber is within the housing having an anti-condensation valve. The fixture includes an air passageway between the optical chamber and at least one of the enclosures. The air passageway causes a vacuum to form in the one of said enclosures when a vacuum forms in the optical chamber.

These and other further features and advantages of the invention would be apparent to those skilled in the art from the following detailed description, taking together with the accompanying drawings, in which:

BRIEF DESCRIPTION OF THE DRAWINGS

FIG. 1 is a top view of one embodiment of an in-grade light fixture according to the present invention;

FIG. 2 is a side elevation view of the in-grade light fixture in FIG. 1;

FIG. 3 is a perspective view of the in-grade light fixture in FIG. 1;

FIG. 4 is a perspective exploded view of the in-grade light fixture, in FIG. 1;

DESCRIPTION OF THE INVENTION

Figure 5:
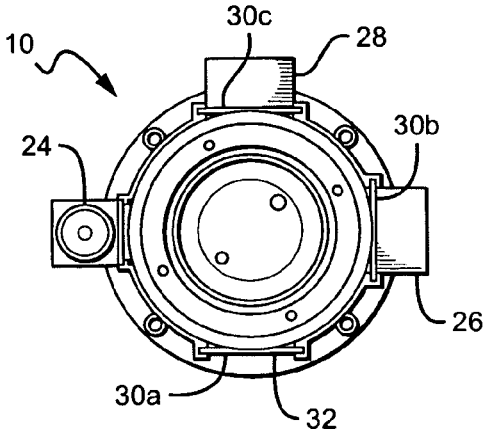
FIG. 5 is a top view of the in-grade light fixture in FIG. 1 with the enclosures arranged differently in the enclosure openings.

The present invention provides an improved light fixture, and although the features are described with reference to in-grade embodiments it is understood that the features can also be used in many other light fixtures pursuant to the present invention. It is also understood that the features and components of the light fixture embodiments described herein can be arranged in many different ways pursuant to the present invention.

FIGS. 1 through 10 show one embodiment of an in-grade lighting fixture 10 according to the present invention that is arranged to be smaller and easier to use compared to conventional in-grade fixtures. It is also arranged to provide greater flexibility in installation and to have greater reliability. As further described below, the fixture has features to prevent condensation in the optical cavity and transformer enclosure to optimize performance and increase the reliability of both. Further, the enclosures containing the ballast components can be mounted in different locations on the exterior of the fixture housing to allow the fixture 10 to be configured to best match the space available at a particular installation location. The fixture also prevents the collection of water in the upper section slot that can reduce reliability, particularly in installations where the temperature can be below freezing.

The lamp fixture 10 also comprises the inventive features of the lamp fixture in U.S. patent application Ser. No. 10/799,393, entitled "In-Grade Light Fixture With Leveling and Alignment Mechanisms, Installation Features and Anti-Condensation Valve," the contents of which are incorporated herein by reference. Some of these features include a faceplate mechanism for adjusting the level and angle of the faceplate and for adjusting the orientation of the faceplate screw holes. Others include a mechanism for holding the light fixture at a desired level in a hole during installation, and an optical chamber anti-condensation valve.

The fixture 10 comprises a generally cylindrical housing 12 divided into upper, middle, and lower sections 14, 16, and 18. The section can be made of many materials and composite materials, with a preferred material being rugged, watertight, and corrosion resistant. One suitable material is a high strength, thermo-formed polyester compound that is formed into the sections 14, 16, and 18 using known methods. The lower section 18 preferably comprises slots in its bottom surface to enable any water that enters the housing to drain out.

The fixture 10 also comprises an optical chamber 20 that is arranged within the housing by the optical chamber's axial lip 22 resting on the top surface of the upper section 14 such that essentially all the chamber 20 is within the housing 12. The optical chamber can be made of many different materials, with a suitable material being a metal.

The optical chamber 20 can be arranged in many different ways and can have many different shapes, but is preferably closed at bottom 21 and has an opening at its top 23 (best shown in FIG. 4). The enclosure bottom can have an electrical connector for supplying power to the optical chamber 20. A lamp (not shown) is mounted within the optical chamber 20 such that it emits light out the top opening of the chamber 20. when power is applied to it. Many different lamps can be used, with a suitable lamp being a commercially 70 W Medium Base Metal Halide Lamp. Other optical chambers according to the present invention can house different types of emitters, including but not limited to light emitting diodes, lasers, fluorescent lights, etc., each of which can be arranged in many different ways within the chamber. The optical chamber 20 can also comprise a mounting system that allows the lamp to pivot to adjust the direction of lamp illumination without changing the position or angle of the chamber 20.

The lighting fixture 10 also comprises a junction box 24 attached at the exterior of the housing 12, and although it can be mounted in many different ways and in many different locations, in the embodiment shown it is mounted with the junction box 24 being substantially outside the housing at opening 25 of the housing's middle section 16. Power is supplied to the junction box 24 from an outside power source along known electrical conductors (not shown), and as is also known in the art, the electrical power for operating the lamps and light fixture components is typically brought to the lighting fixture 10 by wiring contained in an outer protective conduit line that attaches to the housing at a junction box 24. The wiring can be connected to the junction box using a quick disconnect connector having an anti-siphon valve. The junction box 24 provides a wiring compartment for electrically connecting the light fixture to the external supply of power provided by the electrical conductors.

The fixture 10 further comprises first and second exterior electrical enclosures 26, 28 that preferably hold the ballast electrical components, although in other embodiments they can hold other components. The enclosures are preferably mounted to the exterior of the housing's middle section 16 in much the same way as the junction box 24, with the enclosures substantially outside the middle section 16. The middle section 16 has three upper enclosure openings 30*a*, 30*b*, 30*c* each of which is sized such that one of the enclosures 26, 28 can be mounted to the outside of the housing at a respective one of the openings 30*a*, 30*b*, 30*c*. When less than three enclosures are used, such as in the embodiment shown having two enclosure 26, 28, one or more of the openings do not have an enclosure. For those, opening side blanking plate 32 can be inserted to cover the opening.

Each of the enclosures 26, 28 can be mounted to its respective one of the openings 30*a*, 30*b*, 30*c* in many different ways such as by screws, clamps, or bonding materials. In the embodiment shown, each of the enclosures 26, 28 has a ridge 31 sized to fit within a slot 33 in the openings to hold the particular enclosure in its opening. When the upper section 14 is mounted on the middle section 16, the enclosures 26, 28 and blanking plate 32 are fixed in their openings. Screws, clamps or bonding materials can also be used with the slot and lip arrangement to more securely mount the particular one of the enclosures 26, 28 within its opening and sealants or gaskets can be included at the openings to provide a watertight seal.

The housing's lower section 18 can also have first and second bottom enclosure openings 34*a*, 34*b* that are also sized to hold the first and second enclosures 26, 28. By including three middle section openings 30*a*, 30*b*, 30*c* and two bottom section openings 34*a*, 34*b*, the fixture 10 provides for flexibility in the arrangement of the enclosures to match the confines of an installation location. The fixture is provided with five openings each of which can have an enclosure, which allows for up to five enclosures to be used with the fixture 10, and when less than five are used, allows for the enclosures to be placed in different openings. It is understood that other embodiments of the fixture according to the invention can have more or fewer openings and the openings can be in many different locations. In one embodiment, for example, the fixture does not have bottom enclosure openings.

Referring to FIGS. 1-4, if space were a premium along the edge at the opening 30*c* during installation, a blanking plate can be installed in the opening 30*c* as shown and the first and second enclosures 26, 28 can be installed in openings 30*a*, 30*b*. This allows for installation of the fixture 10 without one of the enclosures 26, 28 projecting into the space adjacent to the opening 30*c*. Bottom blanking plates 38 can also be installed in the bottom openings 34*a*, 34*b*.

Figure 6:
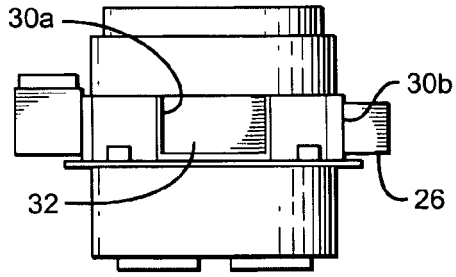
FIG. 6 is a side elevation view of the in-grade light fixture shown in FIG. 5.
Figure 7:
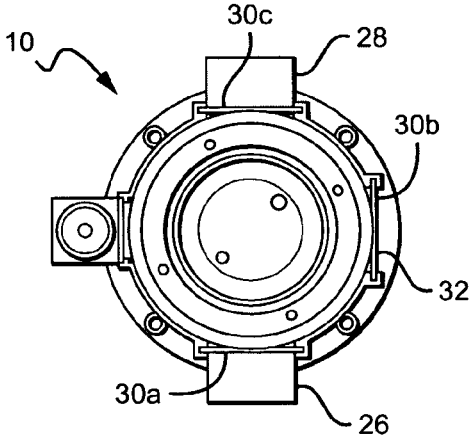
FIG. 7 is a top view of the in-grade light fixture in FIG. 1 with the enclosures arranged differently in the enclosure openings.
Figure 8:
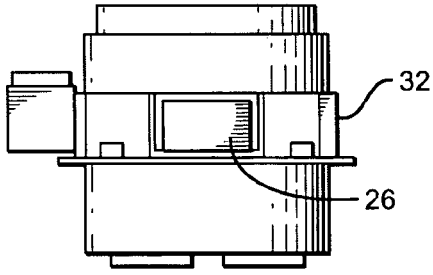
FIG. 8 is a side elevation view of the in-grade light fixture shown in FIG. 7.

Referring now to FIGS. 5 and 6, if space were a premium along the edge at opening 30*a*, a blanking plate 32 can be installed in opening 30*a* and the enclosures 26, 28 can be installed in openings 30*b*, 30*c*. Referring to FIGS. 7 and 8, if space is a premium along opening 30*b*, a blanking plate 32 can be installed in opening 30*b* and the enclosures 26, 28 can be installed in openings 30*a*, 30*c*. In the embodiments of FIGS. 5-8, bottom blanking plates (not shown) are also included in the lower sections bottom openings.

Figure 9:
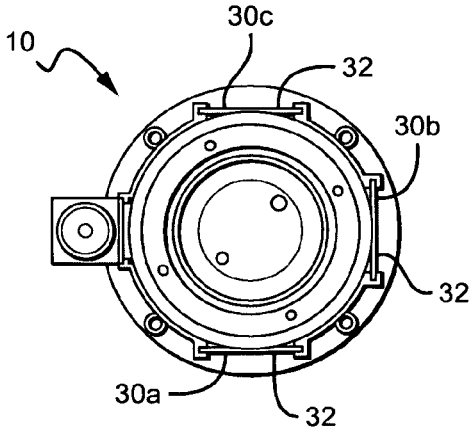
FIG. 9 is still another top view of the in-grade light fixture of FIG. 1 with the enclosures arranged differently in the enclosure openings.
Figure 10:
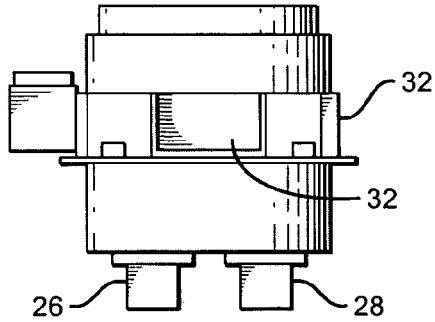
FIG. 10 is a side elevation view of the in-grade light fixture shown in FIG. 9.

Referring now to FIGS. 9 and 10, when space is a premium adjacent to all or some of the openings, 30*a*, 30*b*, 30*c*, but is not as critical below the fixture 10, the enclosures 26, 28 can be installed in the bottom openings 34*a*, 34*b* (shown in FIG. 4). Blanking plates 32 can then be installed in each of the openings 30*a*, 30*b*, 30*c*.

The lighting fixture 10 is generally arranged with two enclosures 26, 28 in those embodiments using magnetic light ignition known in the art. The first enclosure 26 can hold the starting circuit and a capacitor, while the second enclosure 28 holds the transformer. By separating the electronic components in this way heat from the transformer in the second enclosure 28 is less likely to impact the more heat sensitive components in the first enclosure 26.

In those embodiments utilizing electronic light ignition known in the art, the type/size of the electrical components is such that heat transferring from the transformer to the other electrical components is not as much of a concern. All the electronic components can be housed in a single enclosure that can be mounted in any one of the middle section openings 30*a*, 30*b*, 30*c* and bottom section openings 34*a*, 34*b*. Blanking plates would then be included in each of the other openings. In each of the embodiments described herein, the enclosures can include a potting material to help seal the components and to facilitate heat dissipation.

Referring again to the embodiment of FIGS. 1-10 having first and second enclosures 26, 28, power enters the housing 12 through wiring from the junction box 24, with the wires providing power to the first enclosure 26. Power from the first enclosure 26 is then provided to the second enclosure 28 where the transformer then provides the appropriate power signal to energize the lamp in the optical chamber 20. Power from the second enclosure 28 is provided to the optical chamber using known power conductors and connectors with the typical conductors being connected at the base of the optical chamber 20.

Referring now to FIG. 4, the fixture l0 can also have a tube 40 running between the optical chamber 20 and one or more of the enclosures. The tube can be arranged to allow conductors to run through it between the optical chamber and the enclosure, and the tube preferably would not collapse if a vacuum is created in the tube. As shown, the second enclosure 28 has a tube with power conductors running within the tube 40. The tube 40 is connected between the optical chamber 20 and second enclosure 28 using known connectors, with an air -tight seal between the tube and optical chamber 20 and enclosure 28 at the connection points. The tube 40 is also air tight, but is arranged such that air is allowed to pass between the optical chamber and cavity through the tube 40 while preventing air from escaping from the second enclosure 28, optical chamber 20, or tube 40 at the connection points. This arrangement allows for a vacuum to be created in the second enclosure 28 when a vacuum is created in the optical chamber 20 as described below. This vacuum reduces the formation of condensation in the second enclosure 28, which improves the light fixture's performance and reliability.

The optical chamber 20 comprises a valve 42 (shown in FIG. 4) that is fully described in U.S. patent application Ser. No. 10/799,393 referenced above. The valve 42 is designed and positioned to allow air to pass out of the optical chamber 20 when pressure builds up in the chamber 20, and to block ambient air from passing back into the chamber 20. When the chamber 20 is installed in the housing 12 and the faceplate mechanism is mounted in place over the opening of the chamber 20, a seal is created between the faceplate and the chamber 20 such that the inside of the chamber 20 is sealed from the ambient air and the only way for air to pass out of the chamber 20 is through the valve 42. During operation of the fixture 10, air within the chamber 20 and the second enclosure 28 is heated, which causes the air to expand and air pressure to build within the chamber 20 and enclosure 28. As the pressure builds, air passes out of the valve 42.

When the fixture 10 is not operating, the air within the chamber 20 and enclosure 28 cools, but no air is allowed to pass back into the chamber 20 (or enclosure 28) through the valve 42. This results in the formation of a negative air pressure, or vacuum, within the chamber 20 and enclosure 28. This negative air pressure has the benefit of preventing condensation within the chamber 20 and enclosure 28 while not requiring the enclosure to have its own valve. It is understood that additional tubes can be included between the optical chamber 20 and the first enclosure 26, or the junction box 24. The enclosures 26, 28 and junction box 24 can also have their own anti condensation valve and air tight tubes can also run between them.

Figure 11:
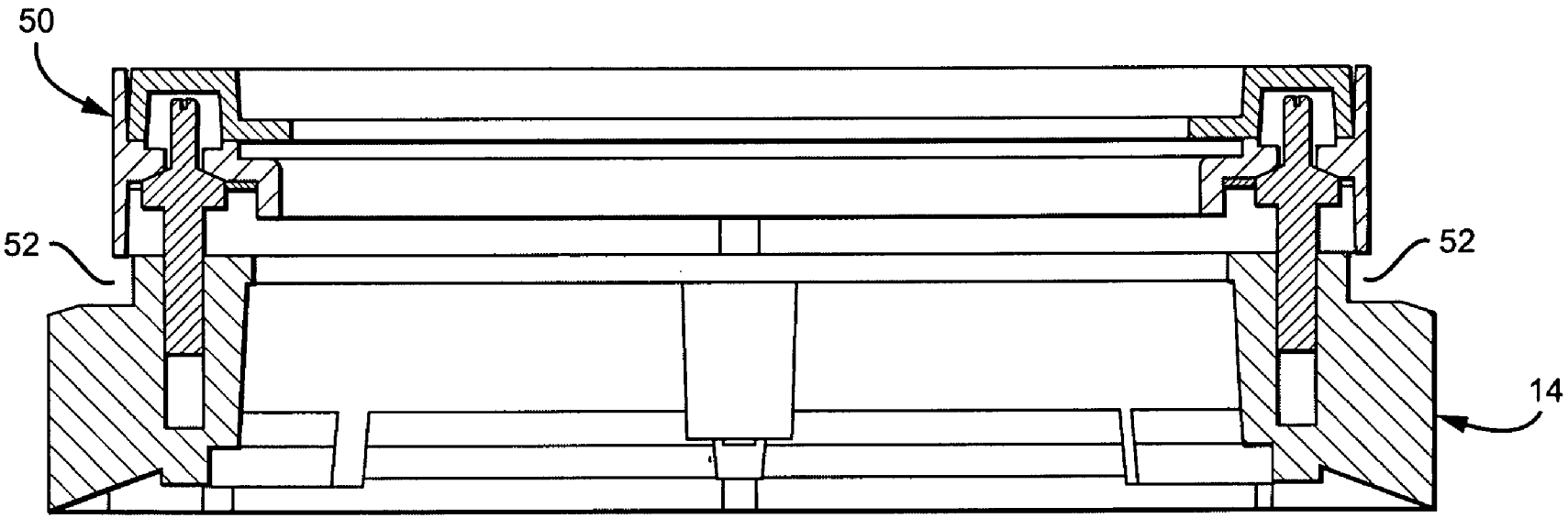
FIG. 11 is a sectional view of the top section of one embodiment of an in-grade light fixture according to the present invention.

FIG. 11 shows a sectional view of the housing's upper section 14, with a faceplate 50 mounted over the opening in optical chamber and faceplate. As described in U.S. patent application Ser. No. 10/799,393 referenced above, the faceplate 50 is arranged to move up or down to align the angle of the faceplate 50. The housing's upper section 14 (or collar) has an groove 52 aligned with the lower edge of the faceplate 50, which allows for a greater range of movement down. than if the upper section 14 had no groove 52. In previous light fixtures the groove was U-shaped. such that water could collect in it and if this water froze, it could force the faceplate 50 out of the groove 52. To prevent this possibility, the upper section has been arranged such that the groove 52 is L-shaped and any water entering the groove 52 simply continues to run out and down the housing. In freezing conditions there is no water in the groove 52 to freeze.

Although the present invention has been described in considerable detail with reference to certain preferred configurations thereof, other versions are possible. Therefore, the spirit and scope of the invention should not be limited to the preferred versions in the specification.

I claim:

1. An in-grade light fixture, comprising:

a light fixture housing arranged to be buried substantially below grade level, said light fixture housing having a light opening substantially at grade level;

an optical chamber having a light source arranged within said chamber and said chamber arranged within said housing with light from said light source passing through said light opening;

a plurality of housing openings; and one or more enclosures, each of which is removably mounted to a respective one of said housing openings, said enclosures accepting external power and generating power to energize said light source causing it to emit light.

2. The light fixture of claim 1, comprising fewer said enclosures than said openings, a blanking plate removably mounted within each of said openings not having an enclosure.

3. The light fixture of claim 1, wherein each of said mounted enclosures is substantially outside said housing.

4. The light fixture of claim 1, wherein one of said enclosures comprises a junction box that accepts external power and transfers said power to the remainder of said light fixture.

5. The light fixture of claim 4, wherein said power is transferred to the remainder of said light fixture along electrical conductors coupled to said junction box by a connector having an anti-siphon valve.

6. The light fixture of claim 1, wherein said lamp is energized utilizing magnetic light ignition, said lamp comprising at least two said enclosures.

7. The light fixture of claim 6, wherein one of said enclosures holding a starter circuit, the second of enclosures holding a transformer.

8. The light fixture of claim 7, wherein said enclosure holding said starter circuit further holding a capacitor.

9. The light fixture of claim 6, wherein said lamp is energized utilizing electronic light ignition and said fixture having one enclosure holding electronic components to accept an external power supply and generate said electronic light ignition.

10. The light fixture of claim 1, comprising openings in the bottom surface of said housing.

11. The light fixture of claim 1, wherein said optical chamber comprises an anti-condensation valve to generate a vacuum in said optical chamber through operation of said lamp.

12. The light source of claim 11, further comprising a tube between said optical chamber and at least one of said enclosures, said tube allowing a vacuum to form in said at least one of said enclosures when a vacuum forms in said optical chamber.

13. The light source of claim 1, wherein electrical conductors pass through said tube between said optical chamber and said at least one of said enclosures.

14. The light source of claim 1, further comprising a groove around said opening having an L-shaped cross-section and a faceplate mechanism arranged over said light opening and held in place by mounting screws, said faceplate mechanism at least partially within said groove.

15. An in-grade light fixture, comprising:

a light fixture housing arranged to be buried substantially below grade level, said light fixture housing having a light opening substantially at grade level;

a junction box mounted to said housing;

a plurality of housing openings; and one or more enclosures, each of said enclosures capable of being removably mounted in a respective one of each of said openings, said enclosures interconnected to accept an external power supply and generate an electrical signal to energize a light source.

16. The light fixture of claim 15, wherein said junction box accepts external power and transfers said power to the remainder of said light fixture.

17. The light fixture of claim 15 further comprising an optical chamber having an anti condensation valve, and an air passageway running between said optical chamber and at least one of said enclosures.

18. The light fixture of claim 17, wherein said air passageway comprises a tube.

19. An in-grade light fixture, comprising:

a light fixture housing arranged to be buried substantially below grade level, said light fixture housing having a light opening substantially at grade level, with a groove around said opening having an L-shaped cross-section;

a light source arranged within said light fixture housing and generating light that passes through said light opening; and an adjustable faceplate mechanism arranged over said light opening and held in place by mounting screws, said faceplate mechanism at least partially within said groove, said groove enabling adjustment of the position of said faceplate mechanism relative to said housing.

20. The light fixture of claim 19, wherein water does not accumulate in said groove when said light fixture is installed.

21. An in-grade light fixture, comprising:

a light fixture housing arranged to be buried substantially below grade level, said light fixture housing a light opening substantially at grade level;

a plurality of enclosures mounted to said housing;

an optical chamber within said housing having an anti-condensation valve; and an air passageway between said optical chamber and at least one of said enclosures, said air passageway causing a vacuum to form in said at least one of said enclosures when a vacuum forms in said optical chamber.

22. The light fixture of claim 21, wherein said air passageway comprises a tube.

23. The light fixture of claim 22, wherein electrical conductors pass between said one of said enclosure and said optical chamber through said tube.

* * * * *